United States Patent [19]

Bröker et al.

[11] 4,146,355

[45] Mar. 27, 1979

[54] HIGH-PRESSURE PLUNGER PUMP

[75] Inventors: Erich Bröker, 4740 Oelde, Fed. Rep. of Germany; Paul Hammelmann, Zum Sundern 17, Oelde, Fed. Rep. of Germany

[73] Assignee: Paul Hammelmann, Oelde, Fed. Rep. of Germany

[21] Appl. No.: 788,773

[22] Filed: Apr. 19, 1977

Related U.S. Application Data

[63] Continuation of Ser. No. 553,170, Dec. 18, 1974, abandoned.

[30] Foreign Application Priority Data

| | | | |
|---|---|---|---|
| Jun. 25, 1973 | [DE] | Fed. Rep. of Germany | 2332250 |
| Mar. 11, 1974 | [DE] | Fed. Rep. of Germany | 2411546 |
| Sep. 25, 1974 | [DE] | Fed. Rep. of Germany | 2445696 |

[51] Int. Cl.[2] ..... F04B 39/12; F04B 39/14

[52] U.S. Cl. ..... 417/454; 417/457

[58] Field of Search ..... 417/469, 454, 570, 457

[56] References Cited

U.S. PATENT DOCUMENTS

| | | | |
|---|---|---|---|
| 466,094 | 12/1891 | Evered | 417/469 |
| 777,827 | 12/1904 | Willmann | 417/570 |
| 1,511,484 | 10/1924 | Peterson | 417/469 |
| 1,768,102 | 6/1930 | Bellem | 417/509 |
| 1,940,524 | 12/1933 | Bellem et al. | 417/469 |
| 2,345,693 | 4/1944 | Wilson et al. | 417/63 |
| 2,361,316 | 10/1944 | Newton et al. | 417/298 |
| 2,537,742 | 1/1951 | Collins | 417/454 |
| 3,811,801 | 5/1974 | Buse et al. | 417/454 |
| 3,868,048 | 2/1975 | Soodacter | 417/469 |

FOREIGN PATENT DOCUMENTS

| | | | |
|---|---|---|---|
| 880453 | 1/1943 | France | 417/469 |
| 926370 | 3/1962 | United Kingdom | 417/570 |

*Primary Examiner*—William L. Freeh

*Attorney, Agent, or Firm*—Michael J. Striker

[57] ABSTRACT

A housing has an interior provided with two communicating compartments, and valve seats are located between these compartments. An inlet communicates with one and an outlet with the other of the compartments. A pressure valve is located in the other compartment and sealingly engages one of the valve seats unless the pressure in the one compartment exceeds the pressure in the other compartment. A plunger is reciprocable in the one compartment toward and away from the valve seat between a suction stroke and an expelling stroke. A suction valve member slidably engages the plunger and is guided solely by the same. The suction valve member sealingly engages the valve seats and moves out of engagement with the same to travel with the plunger during the suction stroke. An abutment limits the travel of the suction valve member during the suction stroke of the plunger.

32 Claims, 15 Drawing Figures

Fig. 1
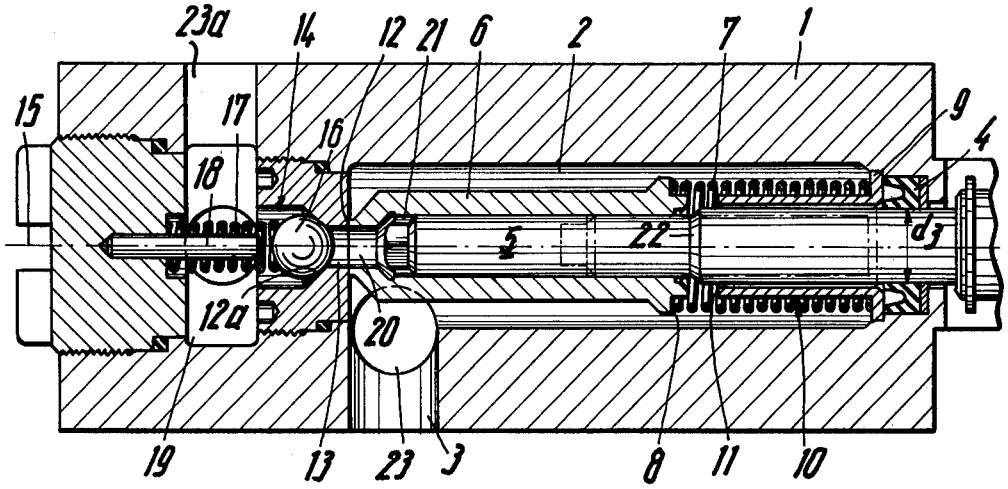
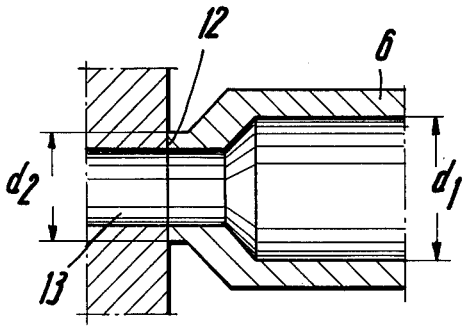
Fig. 2

HIGH-PRESSURE PLUNGER PUMP

This is a continuation of application Ser. No. 533,170, filed Dec. 18, 1974 now abandoned.

BACKGROUND OF THE INVENTION

The present invention relates generally to pumps, and more particularly to a high-pressure plunger pump.

Plunger pumps are used for high-pressure applications. It is known to provide such a plunger pump in which the suction valve body is guided in the cylindrical housing of the pump. This is disadvantageous because at high pressure there is a danger that the suction valve body might become stuck in the housing and not move. Moreover, in the region between the suction valve body and the cylinder wall, heat tends to build up which is disadvantageous. In addition, the known suction valve body must be machined on the inside and on the outside, which adds to its expense.

SUMMARY OF THE INVENTION

Accordingly, it is an object of this invention to overcome the disadvantages of the prior art.

More particularly, it is an object of the present invention to provide a high-pressure plunger pump which is more effective than those known from the prior art, less subject to malfunction, and simpler in its construction.

In keeping with these objects, and with others which will become apparent hereafter, one feature of the invention resides in a high-pressure plunger pump which, briefly stated, comprises a housing having an interior provided with two communicating compartments, and valve seat means between these compartments. An inlet communicates with one and an outlet with the other of the compartments. A pressure valve is located in the other compartment and sealingly engages the valve seat means unless the pressure in the one compartment exceeds the pressure in the other compartment. A plunger is reciprocable in the one compartment toward and away from the valve seat means between a suction stroke and an expelling stroke. A suction valve member slidably engages the plunger and is guided solely by the same. The suction valve member sealingly engages the valve seat means and moves out of engagement with the same to travel with the plunger during the suction stroke thereof. Abutment means limits the travel of the suction valve member during the suction stroke of the plunger.

By guiding the suction valve member exclusively on the plunger, it is no longer necessary to machine the outer surface of the suction valve member, thus saving this operation and reducing the expense involved in constructing the suction valve member. Moreover, a clamping or sticking of the suction valve member in the cylinder of the pump can no longer occur. In the construction according to the present invention the suction valve member has the pumped liquid flow around it so that the heat developing during the pressure stroke is transmitted by the suction valve member directly to the pumped liquid and carried off.

By providing the abutment means mentioned above, the suction stroke of the suction valve member and thereby the opening and closing times are precisely predetermined.

The suction valve member is so provided on the plunger that within the suction valve the high-pressure seal is constructed as a gap seal. During the suction stroke, the suction valve is opened by the attracting plunger due to the liquid flow that is pulled in the gap seal. During the pressure stroke, water is drawn from the suction chamber into the gap between the plunger and the suction valve body, and aids the sealing effect.

In order to improve the weight to throughput ratio of the pump, to make the components that are subject to wear readily accessible, to simplify the assembly of the components and to reduce the expense of producing the pump, it is advantageous if the housing of the pump is composed of a housing section and a separate head section. The latter is connected to the housing section by an appropriate retainer. In this construction, the valve seats for the pressure valve and the suction valve are located in the region of the plane of separation between the housing section and the head section.

The apparatus according to the present invention can be used not only as a plunger pump, but also has a homogenizing device for pastes, cream or the like, or for purposes of accelerating polymerizations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is an axial section through a pump according to the present invention;

FIG. 2 is a fragmentary enlarged-scale detail view showin a detail of FIG. 1;

DESCRIPTION OF THE PREFERRED EMBODIMENTS

Figure 3:
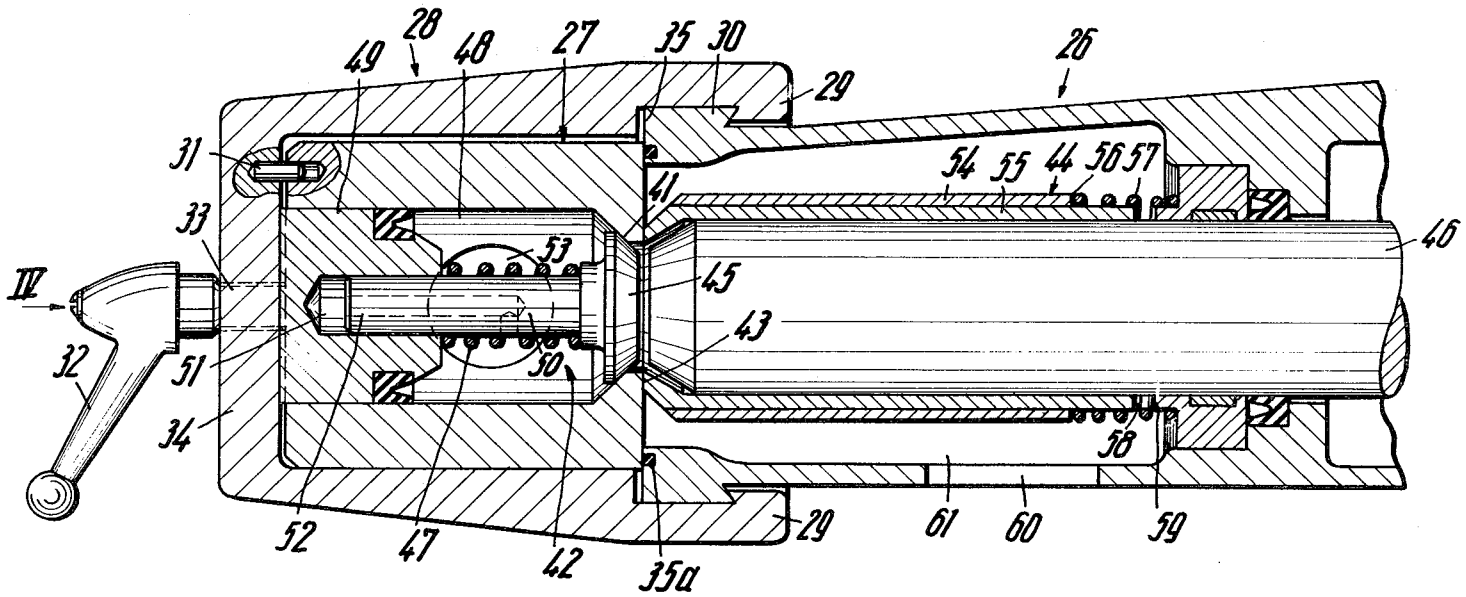
FIG. 3 is a fragmentary axial section of a further embodiment of the invention.

Referring firstly to the embodiment in FIGS. 1 and 2, it will be seen that the pump illustrated therein has a housing 1 formed with a suction compartment 2 which receives liquid, for example water as the liquid will hereafter be called for convenience, via an inlet 3. A plunger 5 extends into the compartment 2 through a low-pressure seal 4; the reciprocation of the plunger 5 can be effected in known manner via a crank shaft, a cross head, or the like (not shown since conventional). The plunger 5 is shown in its forward dead center position (at the end of the pressure stroke) in full lines, whereas it is shown at its rearward dead center position (at the end of its suction stroke) in broken lines. It is evident that a sleeve-shaped suction valve member 6 is slidably mounted on the plunger 5, and has a prestressed spring 7 associated with it. One end of the spring 7 engages the trailing end 8 of the suction valve body 6 whereas the other end of the spring 7 engages a flange 9 on a sleeve 10 which is fixedly mounted in the housing 1. The sleeve 10 extends into the interior of the cylindrical spring 7 and its forwardly directed end face 11 limits the retraction stroke of the suction valve body 6.

The suction valve body 6 cooperates with a valve seat 12 which surrounds the inlet opening 13 of a pressure valve 14 that is centrically mounted with reference to the longitudinal axis 15 of the pump. The pressure valve 14 has a valve member 16 which is here illustrated as a spherical member, but could be otherwise constructed. The valve member 16 contacts a valve seat 12*a* with which it cooperates under the urging of a biasing spring 17. The stroke of the member 16 is limited by an abutment pin 18. When the valve 14 is in open condition, the pressurized water flows into the chamber 19 and from there into the outlet 23*a*. When the plunger 5 is retracted during its suction stroke, the suction valve member 6 follows this movement so that the suction valve opens. The water being drawn in then enters via the inlet 23 and the inlet and outlet ports 20 into the space 21 inside the suction valve body 6 which constitutes the pressure space during the suction stroke of the plunger 5. The cross-sectional area of the pressure space 21 having the diameter d1 is greater than the cross-sectional area of the valve seat 12 having the diameter d2, so that during the pressure stroke an additional closing force for the suction valve is produced by the water pressure acting upon the differential surface area.

During the suction stroke of the plunger 5, towards the right in FIG. 1, reduced pressure develops in the space 21 of the suction valve member 6 and this, in connection with the small pressure existing in the space 2 exerts sufficient force upon the suction valve member 6 is assist the movement of the latter in direction towards the right, that is in an opening sense.

It is also possible, but not shown in FIG. 1, to construct the plunger 5 and the associated inner surface of the suction valve body 6 with a micro-labyrinth seal in which the circumferential recesses in the plunger are offset with reference to those in the suction valve body 6. During the relative movement of the plunger with reference to the suction valve body 6, this will result in eddys in the water, which facilitates the sealing effect between the plunger and the suction valve body 6.

In the embodiment in FIGS. 1 and 2, the inner diameter d3 of the low-pressure seal 4, and the corresponding diameter of that end of the plunger 5 which does not enter into the suction valve body 6, are greater than the diameter d1 of the remaining portion of the plunger 5, that is the portion that enters into the suction valve body 6. This construction is particularly advantageous if employed in a high-pressure plunger pump which has a plurality of plungers that operate not simultaneously, but sequentially. During the pressure stroke of the plunger, suctioned water is forced from the space 2 via the outlet 23 into the suction chambers associated with the other plungers, due to the fact that the shoulder 22 is formed as a result of the increased diameter d3. This improves the total suction relationship in the pump.

The sleeve-like construction of the suction valve body 6 makes possible in a very simple manner to construct the suction valve body 6 in a strong and dimensionally stable configuration, so that it does not change its form when subjected to forces during the pressure stroke, and so that the sealing gap between the body 6 and the plunger always remains at a predetermined size.

In the embodiment in FIG. 3, the pump housing 26 is separate from the pump head 27. The latter is connected to the pump housing 26 via a U-shaped retainer 28 whose arms are provided with anchoring portions 29 which interengage with anchoring portions 30 on the pump housing 26. The construction shown in FIG. 3 is of dovetail-shaped configuration, but could also be shaped otherwise. The retainer 28 together with the pump head 27 which it embraces, can be pushed onto the housing 26 from one side, that is, for example, normal to the plane of FIG. 3. The pump head 27 is properly positioned with reference to the retainer 28 by centering pins 31.

Figure 4:
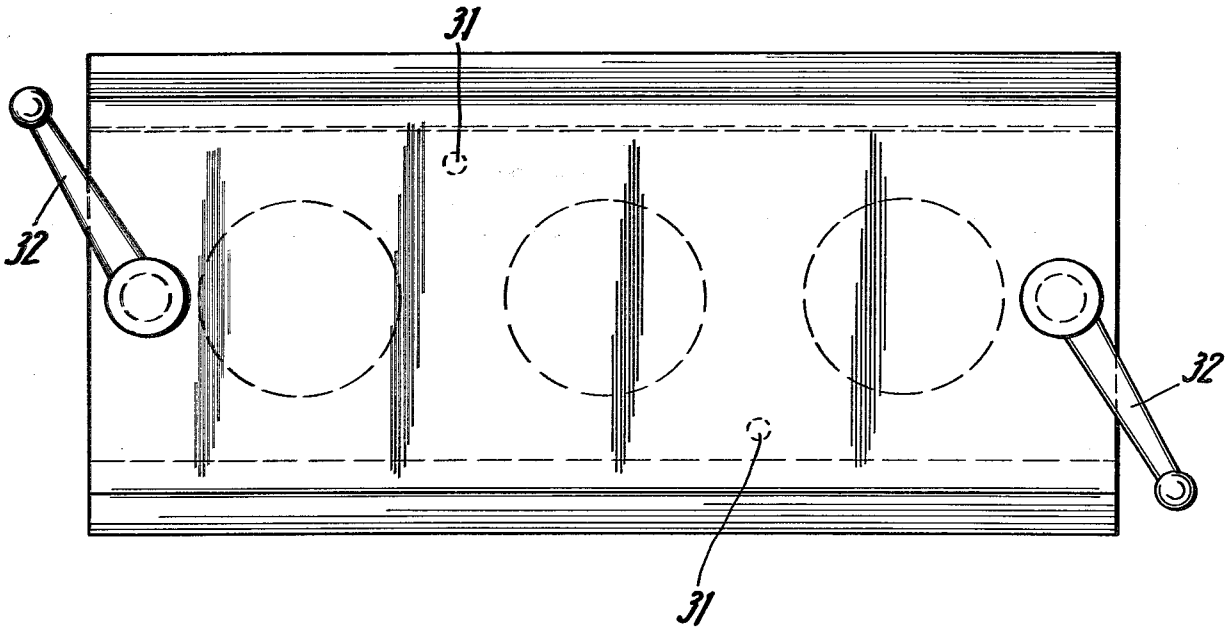
FIG. 4 is a view in the direction of the arrow IV in FIG. 3.

In the embodiment in FIGS. 3 and 4, the retainer 28 with the pump head 27 is positioned on the housing 26 in the manner just described, and thereupon capstan-head screws 32 are tightened whose threaded portion 33 passes through a tapped bore in the center part 34 of the retainer 28 so as to bear against the side walls of the pump head 27. This presses the pump head 27 against the end face 35 of the housing 26, and the engaging portions 29 are pressed against the engaging portions 30. A sealing ring 35*a* is located between the pump head 27 and the end face 35 of the housing 26. The screws 32, 33 thus provide for a prestressing between the pump head 27, the housing 26 and the retainer 28, this prestressing is maintained at all times unless the screws 32 are released.

Figure 6:
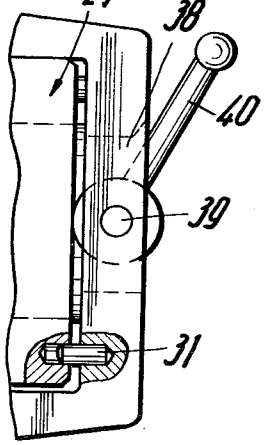
FIG. 6 is a view of FIG. 5, seen in the direction of the arrow VI.
Figure 5:
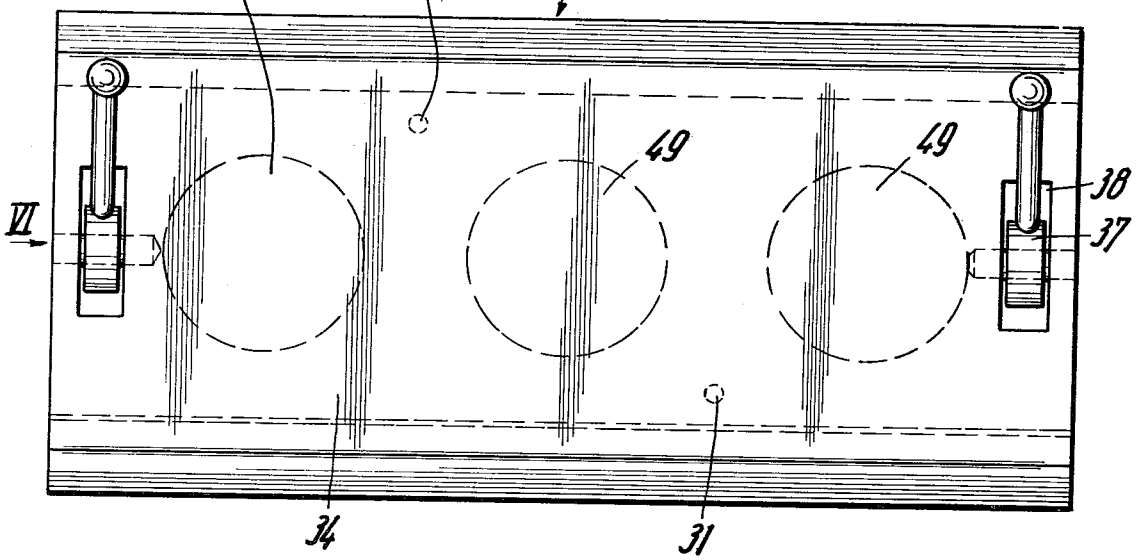
FIG. 5 is a view similar to FIG. 4 illustrating a somewhat different embodiment.

FIGS. 5 and 6 show that it is possible to use instead of the screws 32, 33 of FIGS. 3 and 4, eccentrics 37 which are mounted in respective recesses 38 of the center portion 34 of the retainer 28, so as to be turnable about the respective axis 39, and which can be turned via handles 40. The operation will be clear.

Figure 7:
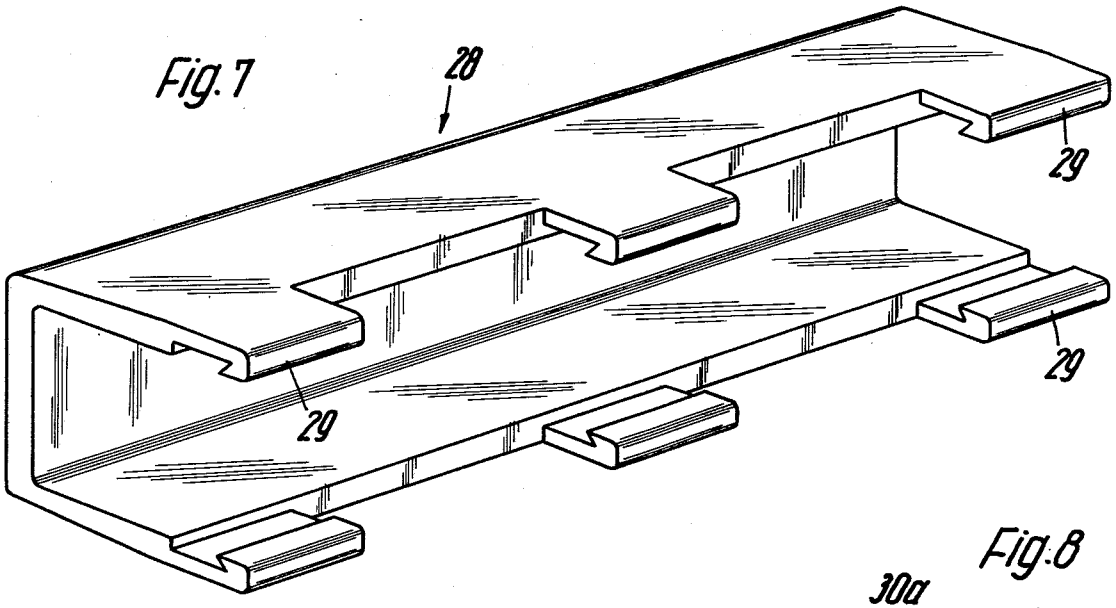
FIG. 7 is a perspective view illustrating a component of the embodiment in FIG. 3.

The portions 29 of the retainer 28 could be strip-shaped and extend over the entire width (normal to FIG. 3) or of the retainer 28. However, as shown in FIG. 7, it is also possible to have them be interrupted so that they are provided with a plurality of sections that are of hooked-like configuration.

Figure 8:
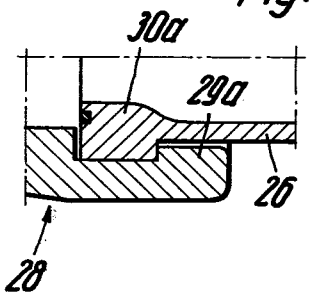
FIG. 8 is a fragmentary section illustrating a somewhat different embodiment of the invention.

A dovetail-shaped interengagement between the portions 29 and 30 is not absolutely necessary. For instance, a configuration such as shown in FIG. 8 could also be utilized, in which the cooperating abutment surfaces of the portions 29*a* and 30*a* extend at a right angle to the wall of the pump housing.

The valve seat 41 of the pressure valve 42 and the valve seat 43 of the suction valve member 44 are located, in the embodiment of FIGS. 3 and 4, in the plane of separation of the housing 26 and the pump head 27. This has the advantage that if the valve seats must be inspected or repaired, for instance refaced, this can be carried out in a simple manner because they are readily accessible after the pump head 27 is detached from the housing 26.

The pressure valve body 45 engages under the urging of a biasing spring 47 its associated valve seat 41, when the plunger 46 performs its suction stroke, so that the pressure valve 42 closes the chamber 48 for the liquid being pumped. At the side opposite the valve seat 41, the chamber 48 is formed with an opening which is closed by a slidable piston 49. This bears against the center portion 34 of the retainer 28, so that the pressure in the chamber 48 determines the force with which the piston 49 presses against the center portion 34. This means that the prestress obtained by operation of the screws 32, 33 or the eccentrics 37, 40 has superimposed upon it a stress which is variable and depends upon the pressure in the chamber 48.

The valve body 45 of the pressure valve 42 is formed with a pin 50 the free end of which is slidably received in a blind bore 51 of the piston 49. To obtain a pressure equalization between the chamber that is formed in the blind bore 51 by the presence of the pin 50, and the chamber 48, the pin 50 is formed with an angled channel 52 which communicates both with the blind bore 51 and the chamber 48. The restoring spring 47 surrounds the pin 50 and bears with one of its ends against the piston 49.

The embodiments illustrated in the drawing may each have three plungers; for example, in FIGS. 3 and 4, there may be three of the plungers 46 and thus the pump head 27 would have three of the chambers 48. These chambers will then be connected with one another by openings or bores 53 via which there will be a pressure equalization within the pump head 27.

In the embodiment of FIGS. 3 and 4, the suction valve member 44 is composed of two cylindrical sleeves 54, 55 which are connected with one another by shrinking or in another suitable manner. The trailing end 56 of the sleeve 54 constitutes a supporting surface for one end of the restoring spring 57 acting upon the suction valve member 44. During the suction stroke of the plunger 46, during which the suction valve member 44 follows the movement of the plunger 46 counter to the biasing action of the spring 57, the end 58 of the sleeve 55 engages an abutment surface 59 which serves to limit the movement of the suction valve member 44. This movement of the suction valve member 44 is smaller than the maximum possible compression of the spring 57. The medium to be pumped is drawn during the suction stroke via an opening 60 into the suction space 61, and from there it enters into the space delimited by the suction valve member 44 and the plunger 46, which space constitutes the pressure space during the pressure stroke of the pump. It is clear, therefore, that the construction according to the present invention assures that it is exclusively the suction valve body 44 which is subjected to the varying stresses that occur during the suction stroke and the pressure stroke.

Figure 9:
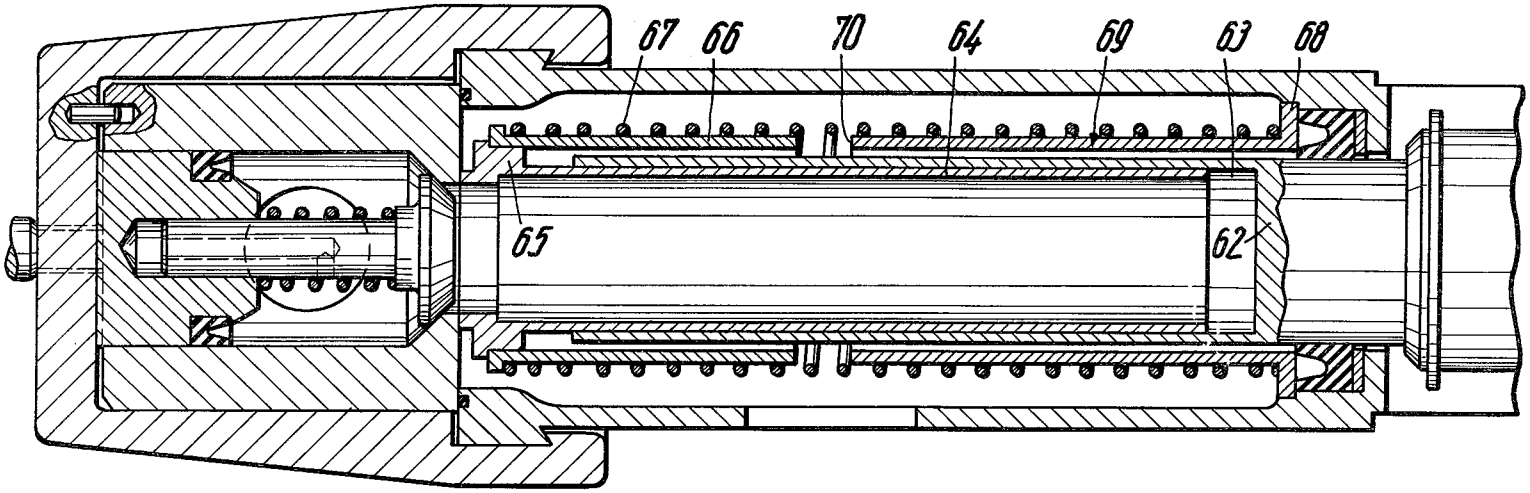
FIG. 9 is a fragmentary axial view illustrating a further embodiment of the invention.

Coming now to the embodiment in FIG. 9, it will be seen that this differs from that in FIGS. 3 and 4 essentially in the construction of the plunger and the suction valve member. In FIG. 9, the plunger 69 is a hollow plunger in the interior 63 of which the sleeve-shaped suction valve member 64 is slidably accommodated. Provided at the forward end 65 of the suction valve member 64 is a sleeve 66 which surrounds the hollow plunger 62 with play and which is abutted by one end of the restoring spring 67 whose other end bears upon a flange 68 of a sleeve 69 which is stationarily mounted in the housing and whose end face 70 constitutes an abutment for the sleeve 66 during the suction stroke of the pump. This abutment limits the suction stroke of the suction valve member 64.

Figure 10:
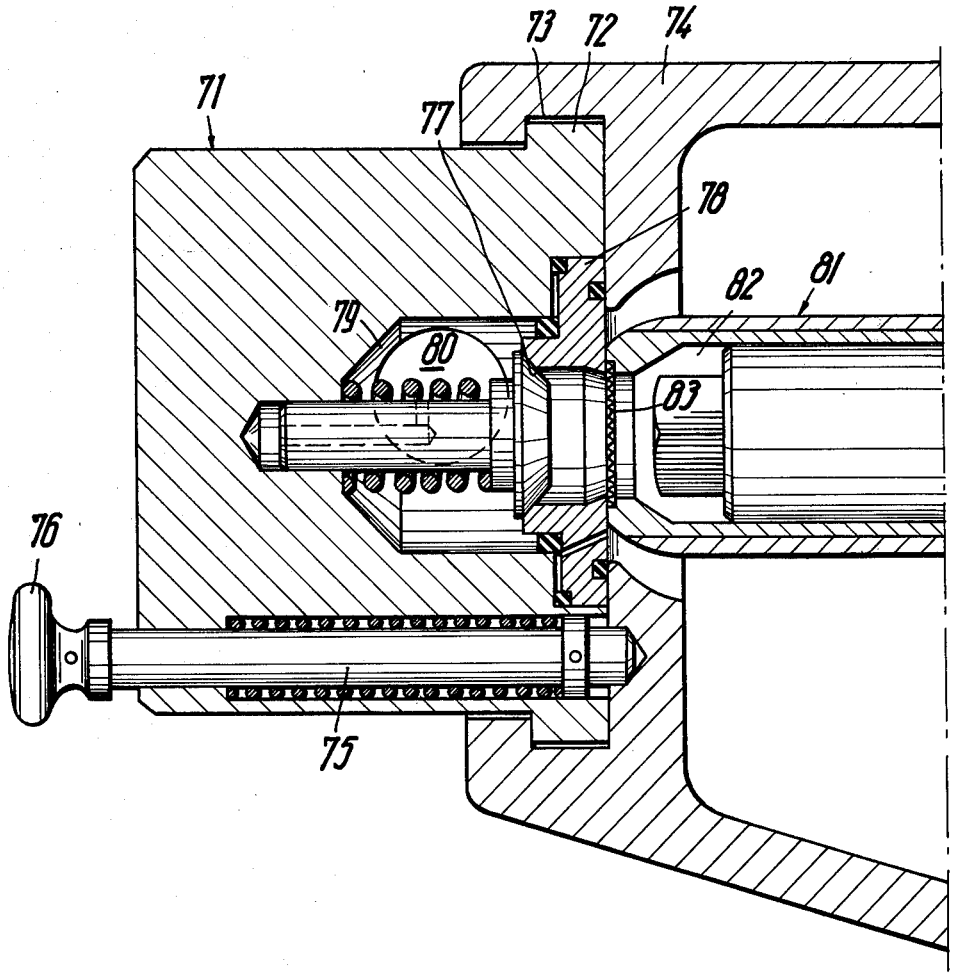
FIG. 10 is a fragmentary axial section, on an enlarged scale, of an additional embodiment of the invention.

The embodiment in FIG. 10 is a construction in which the pump head 71 is provided at opposite ends with flange portions 72 which are insertable into a groove 73 of the pump housing 74 to connect the pump head 71 with the pump housing 74 and orient them in a predetermined relative position. The pump head 71 is arrested with reference to the pump housing 74 by spring-biased bolts 75 each of which is formed with a handle or knob 76. The valve seat 77 of the pressure valve, and the valve seat of the suction valve are both provided on a valve seat ring 78 mounted in the pump head 71; this valve seat ring 78 can be readily removed for inspection and repair or replacement merely by disengaging the pump head 71 from the pump housing 74.

If two or more plungers are provided in the housing of the pump laterally adjacent one another, then each of these plungers has a separate valve seat ring 72 associated with it. This construction assures that the varying stresses which result when one or more plungers perform a suction stroke while one or more other plungers perform at the same time a pressure stroke, are not transmitted to the entire pump head 71. In the embodiment of FIG. 10, the stresses are essentially limited to the region of the respective valve seat ring 78. It is clear that in this embodiment any components that are subject to wear can be readily and without any particular difficulty and expense be inspected and repaired or replaced.

The fluid chambers 79 in the pump head 71 are connected with one another via a bore or opening 80. The pressure existing in these chambers causes a stress to be set up between the pump head 71 and the housing 74, and the higher the pressure in the chambers 79, the more pronounced will be the stress.

A screen 83 may be mounted in the suction valve opening to prevent dirt or other contaminants from passing out of the suction space of the pump into the interior space 82 surrounded by the suction valve member 81.

Figure 11:
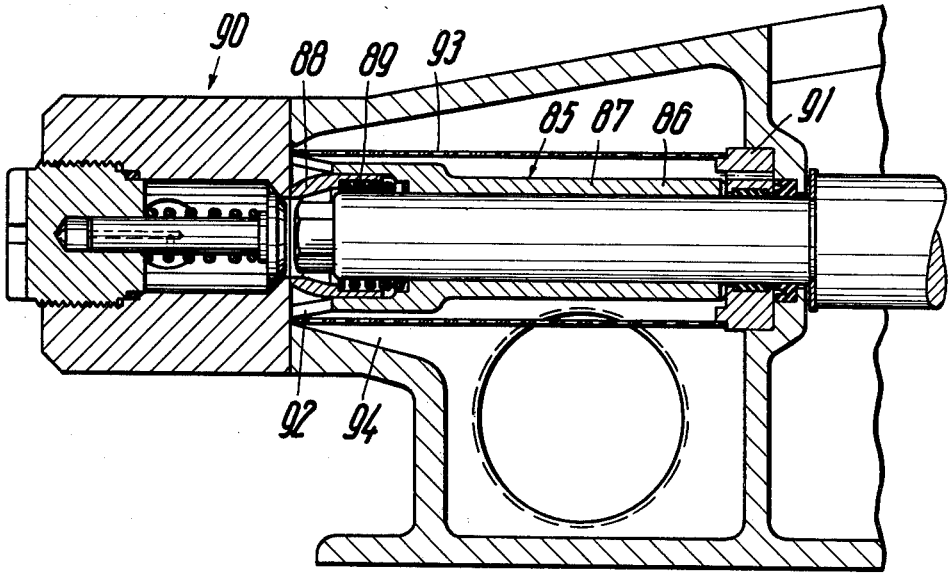
FIG. 11 is a view analogous to FIG. 10 illustrating a further embodiment of the invention.
Figure 12:
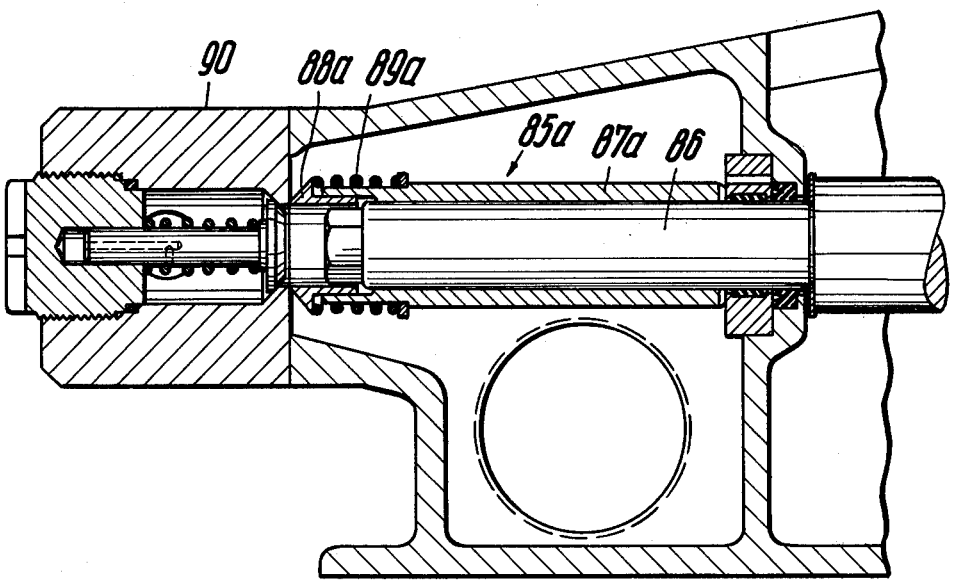
FIG. 12 is a view similar to FIG. 11 illustrating a different embodiment.
Figure 13:
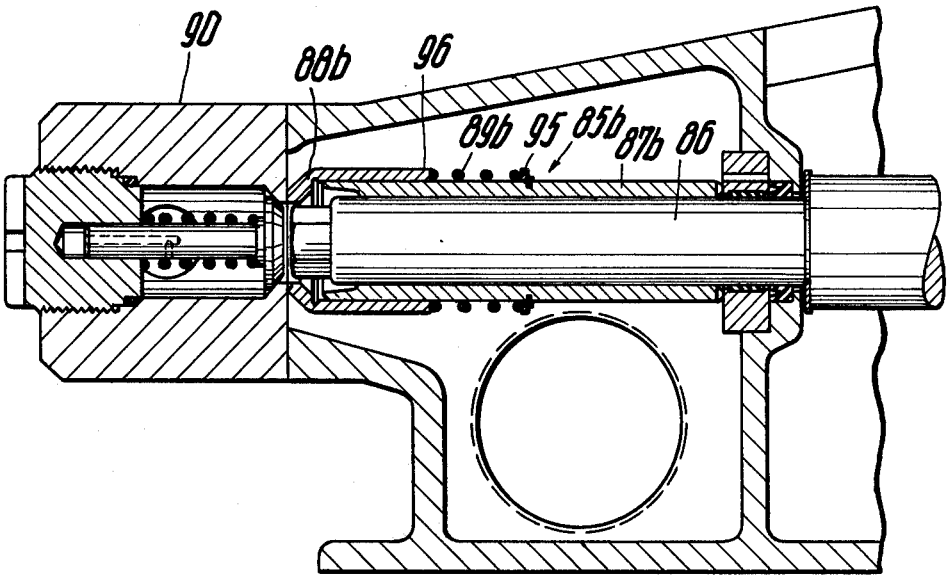
FIG. 13 is a view also similar to FIG. 11, but illustrating a further modification of the embodiment.

The embodiments of FIGS. 11, 12 and 13 can essentially be treated together. It will be understood that they are suitable not only for horizontally oriented pumps, but also for upright pumps. In these embodiments, the suction valve body 85, 85*a* and 85*b* is of two-part construction. In FIG. 11, the suction valve body 85 has a sleeve 87 which is guided on the plunger 86, and a valve part 88. A spring 89 is located between and acts upon the valve part 88 and the sleeve 87 which latter is arranged with a small amount of play intermediate the pump head 90 and the rear plunger guide 91. In the region of the pump head 80, the sleeve 87 is provided with slots 92. A tubular screen 93 surrounds the suction valve member 85. When the plunger is retracted during the suction stroke, a vacuum forms in the interior space of the suction valve member 85 so that the valve part 88 opens while the spring 89 is stressed. If there is any pressure present in the suction space 94, then the opening force acting upon the valve part 88 will be that much greater.

In the embodiment of FIG. 12, the valve part 88*a* is also guided within the sleeve 87*a*, but the spring 89*a* is located outside the sleeve 87*a*. In other respects, the embodiment of FIG. 12 is the same as that in FIG. 11.

This is also true of the embodiment of FIG. 13, wherein, however, the valve part 88*b* is guided on the sleeve 87*b*. The spring 89*b* acts between the sleeve 87*b* and the valve part 88*b* and bears with one end against an abutment ring 95 which is firmly mounted on the sleeve 87*b*. This ring may be a circlip that is received in a groove of the sleeve 87*b*. The other end of the sleeve 89*b* bears upon a rear end face 96 of the valve part 88*b*.

Figure 14:
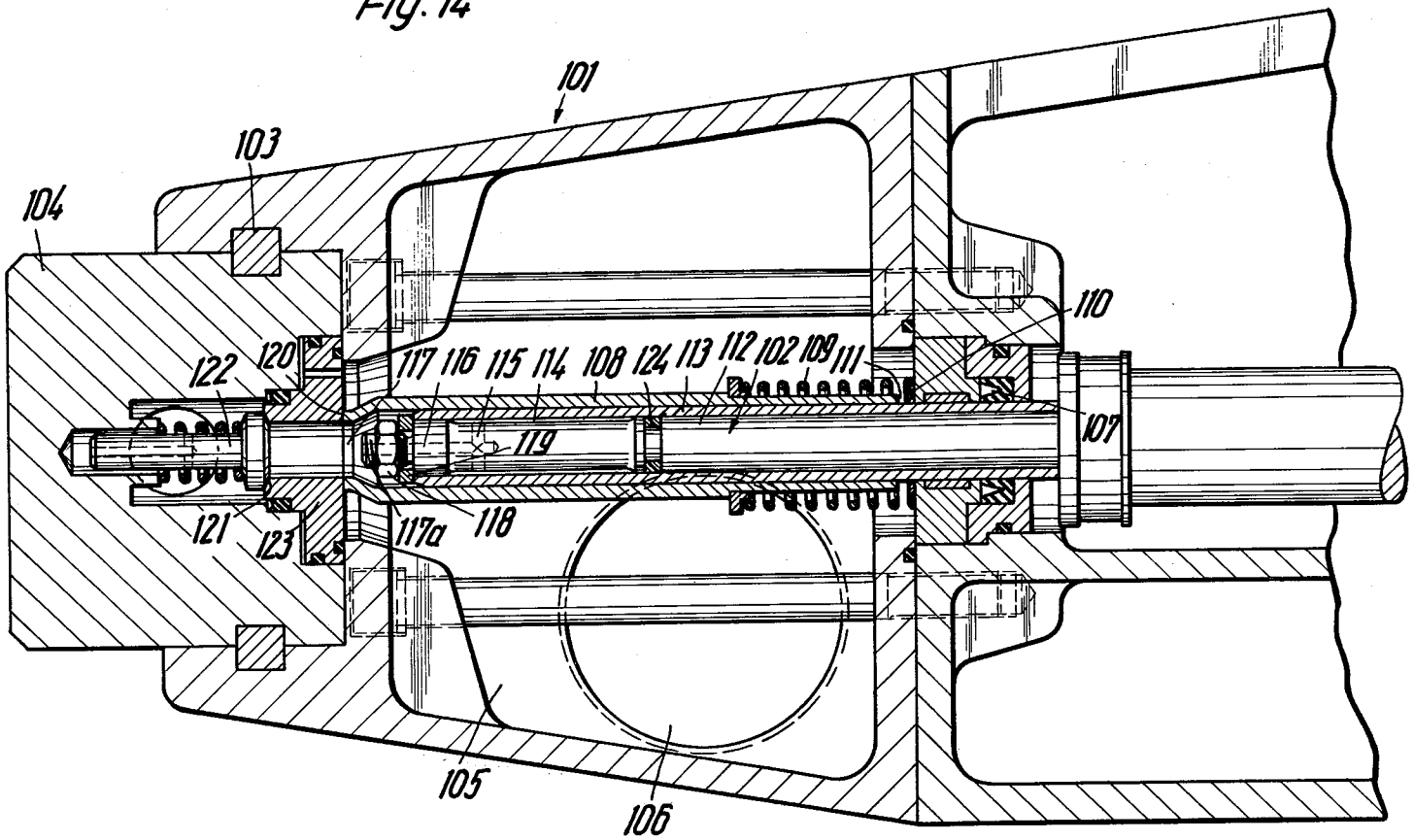
FIG. 14 is a fragmentary axial section through yet an additional embodiment of the invention.
Figure 15:
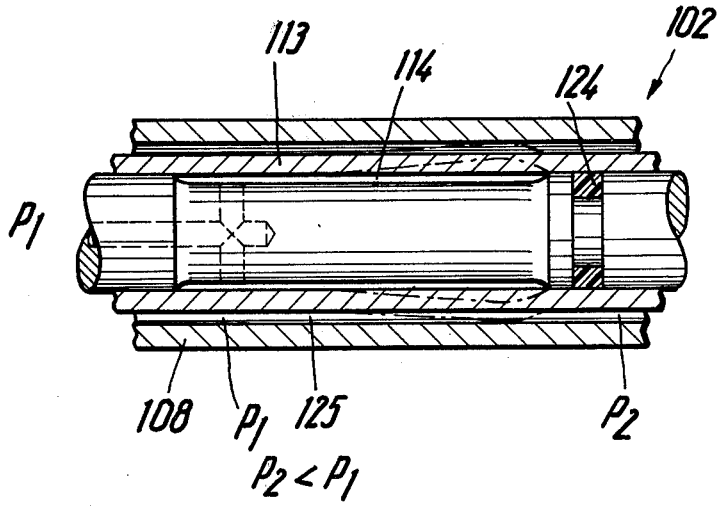
FIG. 15 is a fragmentary sectional detail view showing a detail of FIG. 14 on an enlarged scale.

Coming to the embodiment of FIGS. 14 and 15, it will be seen that here there is provided a pump housing 101. A plurality of plungers 102 (only one shown) is mounted in this pump housing 101, being located laterally adjacent one another. The pump housing 101 is connected with the separate pump head 104 by means of rods or bars 103 which can be pushed laterally into cooperating grooves formed in the housing 101 and the pump head 104, as evident from FIG. 14.

The pump housing 101 is provided with a suction compartment or chamber 105 which receives water via the channel 106. The illustrated plunger 102 extends into the suction compartment 105 through a seal 107 and can be reciprocated in known manner, for instance again via a crank shaft or the like.

The suction valve body 108 is exclusively guided on the plunger 102 associated with it, and has a cooperating spring 109 which tends to maintain the suction valve body 108 in closed position, that is the position that is illustrated in FIG. 14. During the suction stroke of the plunger 102, the force of the spring 109 that acts upon the suction valve member 108 must be overcome. The suction stroke of the suction valve member 108 is delimited by an abutment 110 which is engaged by the rear end face 111 of the suction valve body 108 during the suction stroke.

Each plunger 102 is composed of a rod portion 112 and a sleeve portion 113 surrounding the rod portion 112. The latter is formed in the forward region of the plunger 102 with an annular recess which forms an annular space 114 which is delimited in outward direction by the presence of the sleeve 113. The annular space 114 communicates via a transverse bore 115 and an axial bore 116 in the rod portion 112 of the plunger 102 with the pressure compartment 117 of the pump which is formed by the suction valve body 108. The bore 116 extends in the illustrated embodiment through a threaded section 117*a* which projects forwardly from the front end of the rod portion 112 and onto which a nut 118 is threaded which holds in place an abutment plate 119 for the forward annular end face of the sleeve 113. The valve seat 120 of the suction valve 108 and the valve seat 121 of the pressure valve member 122 are both provided on a valve seat ring 123 which is mounted in a recess of the pump head 104 and can be readily removed after the pump head 104 has been separated from the housing 101.

Adjacent the rear end of the annular space 114, between the rod portion 112 and the sleeve 113 of the plunger, there is provided a sealing ring 124. FIG. 15 shows the sealing gap 125 between the suction valve body 108 and the sleeve 113 of the plunger 102 on an enlarged scale. It will be understood that pressure in the pressure space P1 decreases in the gap 125 in the direction towards the drive end (the right end in FIGS. 14 and 15) of the plunger and reaches in the end region of the space 114 a value P2. Since the space 114 is slightly offset from the forward end of the plunger in direction towards the rearward end, the pressure during the pressure stroke will be less in the gap 125 than the pressure in the space 114 which corresponds to the pressure in the pressure space 117. This results in a deformation of the sleeve 117 which is shown in broken lines in FIG. 15 and leads to a reduction of the cross section of the gap 125. The deformation of the sleeve 117 under the pressure of the fluid being pumped is within the elastic limit of the material of the sleeve 113, so that when the pressure decreases, the sleeve returns to its original configuration. In this manner, it is possible to obtain a reliable seal between the plunger and the suction valve body even in pumps which operate at very high pressures of 1000 bar and more.

It will be understood that each of the elements described above, or two or more together, may also find a useful application in other types of constructions differing from the type described above.

While the invention has been illustrated and described as embodied in a high-pressure plunger pump, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high-pressure plunger pump, comprising a housing having an interior provided with two communicating compartments, said housing including a housing section having one compartment, and a head section having another compartment, and retaining means for retaining said sections connected to one another; planar valve seat means located between said compartments at a first plane; an inlet communicating with said one and an outlet communicating with said other of said compartments; a pressure valve in said other compartment and having a planar front end face located at said first plane unless the pressure in said one compartment exceeds the pressure in said other compartment; a plunger reciprocable in said one compartment toward and away from said valve seat means between a suction stroke and an expelling stroke and having a planar leading end face which is located at said first plane upon completion of said expelling stroke; a suction valve member slidably engaging said plunger and guided solely by the same, said suction valve member having a planar leading end face biased into sealing engagement with said planar valve seat means so as to be located at said first plane and moving out of engagement with the same to travel with said plunger during said suction stroke, said suction valve member also having an end portion facing away from said valve seat means; spring means engaging and permanently urging said suction valve member into engagement with said valve seat means and having a spring; and abutment means limiting the travel of said suction valve member during said suction stroke of said plunger and comprising an abutment sleeve mounted in said one chamber spaced from said end portion and valve seat means, said spring of said spring means bearing upon said end portion and said abutment sleeve, respectively; said housing having a plane of separation at which said sections of said housing engage one another, said plane of separation coinciding with said first plane at which said planar valve seat means is arranged and at which said end faces of said pressure valve, plunger and suction-valve member are located in respective positions thereof.

2. A high-pressure plunger pump, comprising a housing having an interior provided with two communicating compartments, said housing including a housing section having one compartment, and a head section having another compartment, and retaining means for retaining said sections connected to one another, said housing also having an opening communicating with said one compartment; planar valve seat means located between said compartments at a first plane; an inlet communicating with said one and an outlet communicating with said other of said compartments; a pressure valve in said other compartment and having a planar front end face located at said first plane unless the pressure in said one compartment exceeds the pressure in said other compartment; a plunger reciprocable in said one compartment toward and away from said valve seat means between a suction stroke and an expelling stroke and having a planar leading end face which is located at said first plane upon completion of said expelling stroke, said reciprocable plunger extending in part outwardly through said opening of said housing; a low-pressure seal sealing said opening against escape of fluid; a suction valve member slidably engaging said plunger and guided solely by the same, said suction valve member having a planar leading end face biased into sealing engagement with said planar valve seat means so as to be located at said first plane and moving out of engagement with the same to travel with said plunger during said suction stroke; and abutment means limiting the travel of said suction valve member during said suction stroke of said plunger, said housing having a plane of separation at which said sections of said housing engage one another, said plane of separation coinciding with said first plane at which said planar valve seat means is arranged and at which said end faces of said pressure valve, plunger and suction-valve member are located in respective positions thereof.

3. A high-pressure plunger pump, comprising a housing having an interior provided with two communicating compartments, said housing including a housing section having one compartment, and a head section having another compartment, and retaining means for retaining said sections connected to one another; planar valve seat means located between said compartments at a first plane; an inlet communicating with said one and an outlet communicating with said other of said compartments; a pressure valve in said other compartment of said head section and having a planar front end face located at said first plane unless the pressure in said one compartment exceeds the pressure in said other compartment; a plunger reciprocable in said one compartment of said housing section toward and away from said valve seat means between a suction stroke and an expelling stroke and having a planar leading end face which is located at said first plane upon completion of said expelling stroke; a sleeve-shaped suction valve member located in said one compartment of said housing section and accommodating said plunger in sliding engagement therewith and guided solely by said plunger, said suction valve member having a planar leading end face biased into sealing engagement with said planar valve seat means so as to be located at said first plane and moving out of engagement with the same to travel with said plunger during said suction stroke; and abutment means limiting the travel of said suction valve member during said suction stroke of said plunger, said housing having a plane of separation at which said sections of said housing engage one another, said plane of separation coinciding with said first plane at which said planar valve seat means is arranged and at which said end faces of said pressure valve, as well as of said plunger and suction valve member are located in respective positions thereof.

4. A high-pressure plunger pump, comprising a housing having an interior provided with two communicating compartments, said housing including a housing section having one compartment, and a head section having another compartment, and retaining means for retaining said sections connected to one another; planar valve seat means located between said compartments at a first plane; an inlet communicating with said one and an outlet communicating with said other of said compartments; a pressure valve in said other compartment of said head section and having a planar front end face located at said first plane unless the pressure in said one compartment exceeds the pressure in said other compartment; a plunger reciprocable in said one compartment of said housing section toward and away from said valve seat means between a suction stroke and an expelling stroke and having a planar leading end face which is located at said first plane upon completion of said expelling stroke; a suction valve member located also in said one compartment of said housing section and slidably engaging said plunger and guided solely by the same, said suction valve member having a planar leading end face biased into sealing engagement with said planar valve seat means so as to be located at said first plane and moving out of engagement with the same to travel with said plunger during said suction stroke; and abutment means limiting the travel of said suction valve member during said suction stroke of said plunger, said housing having a plane of separation at which said sections of said housing engage one another, said plane of separation coinciding with said first plane at which said planar valve seat means is arranged and at which said end faces of said pressure valve, as well as of said plunger and suction valve member are located in respective positions thereof.

5. A pump as defined in claim 4, said plunger having a first portion received in said suction valve member and a larger-diameter second portion located outside said suction valve member.

6. A pump as defined in claim 4, wherein said suction valve member is composed of two telescoped-together rigidly connected cylindrical sleeves.

7. A pump as defined in claim 4, wherein said plunger is hollow and said suction valve member is guided therein for slidable displacement.

8. A pump as defined in claim 4, wherein said valve seat means comprises a valve seat ring mounted in said head section and formed with a pair of valve seats for said pressure valve and suction valve member, respectively.

9. A pump as defined in claim 4, said suction valve member having an intake port; and further comprising a screen extending across said port.

10. A pump as defined in claim 4, said housing section having a plurality of additional ones of said one compartment, all located laterally adjacent one another and said head section having a plurality of additional ones of said other compartments also all located laterally adjacent one another; aperture means connecting all of said other compartments with one another; and additional pressure valves, plungers and suction valve members associated with the respectively cooperating additional one and other compartments.

11. A pump as defined in claim 4, further comprising a second valve seat means extending to said separation plane wherein said pressure valve includes sides outwardly diverging from said planar front end in directions away from said plunger, said sides sealingly engaging said second valve seat means.

12. A pump as defined in claim 4, and further comprising spring means engaging and permanently urging said suction valve member into engagement with said valve seat means.

13. A pump as defined in claim 4, said retaining means comprising a substantially U-shaped retainer member having projecting arms which embrace said head section between them; and further comprising interlocking connecting portions on said free ends and said housing section, respectively.

14. A pump as defined in claim 13, said housing having a longitudinal axis and said retaining member and housing section having transversely of said axis a predetermined width; and wherein said connecting portions are substantially strip-shaped and extend over substantially said entire predetermined width.

15. A pump as defined in claim 14, wherein said strip-shaped connecting portions on at least one of said retaining members and housing section are continuous.

16. A pump as defined in claim 14, wherein said strip-shaped connecting portions on at least one of said retaining members and housing section are discontinuous.

17. A pump as defined in claim 13, said U-shaped retaining member also having a bight portion connecting said arms and extending across said head section adjacent an end thereof that is remote from said housing section; and further comprising bracing means for bracing said bight portion relative to said housing.

18. A pump as defined in claim 17, wherein said bracing means comprises threaded members mounted in said bight portion and bearing upon said head section.

19. A pump as defined in claim 17, wherein said bracing means comprises eccentrics mounted in said bight portion and bearing upon said head section.

20. A pump as defined in claim 4, said head section having a wall located opposite to and spaced from said valve seat means and formed with an opening registering therewith; and further comprising a shiftable piston extending through said opening and bearing against said retaining means.

21. A pump as defined in claim 20, said piston having an end facing said valve seat means and formed with an inwardly extending blind bore; and wherein said pressure valve comprises a pressure valve member engageable with said valve seat means, and a pin projecting from said pressure valve member and axially slidably received in said blind bore and formed with a passage which communicates with said blind bore and with said other compartment to permit pressure equalization therebetween.

22. A pump as defined in claim 21, said pressure valve further comprising a biasing spring surrounding said pin intermediate said piston and said pressure valve member and bearing upon both thereof.

23. A pump as defined in claim 4, wherein said suction valve member comprises a sleeve slidably surrounding said plunger, a valve body slidable relative to said sleeve, and a spring bearing upon said sleeve and said body.

24. A pump as defined in claim 23, wherein said valve body is slidable within said sleeve.

25. A pump as defined in claim 23, wherein said valve body is slidable on the interior of said sleeve.

26. A pump as defined in claim 23; further comprising a plunger guide in said housing section spaced from said head section; and wherein said sleeve is arranged with slight play intermediate said head section and said plunger guide and is formed with slots adjacent said head section.

27. A pump as defined in claim 26; and further comprising a tubular screen surrounding said sleeve.

28. A pump as defined in claim 4, one of said compartments being a pressure chamber; and wherein said plunger comprises a sleeve portion, and a rod portion extending through said sleeve portion and having a periphery formed with an annular recess which communicates with said pressure chamber via at least one bore.

29. A pump as defined in claim 28, wherein said plunger has a portion in the region of said pressure valve, and said annular recess is formed in said portion of said plunger.

30. A pump as defined in claim 28, wherein said annular recess has one axial end closer to and another axial end further from said pressure valve; and further comprising a sealing ring interposed between said rod portion and said sleeve portion in the region of said other axial end.

31. A pump as defined in claim 28, said rod portion having an end in the region of said pressure valve and provided with an axially projecting threaded section; an abutment plate for said sleeve portion on said threaded section; and a nut threaded onto said threaded section for holding said abutment plate in place.

32. A pump as defined in claim 31, said bore including a first bore portion extending centrally and axially through said rod portion and threaded section, and at least one transverse bore portion extending from said central bore portion to said annular recess.

* * * * *